US005333549A

United States Patent [19]

Feldman

[11] Patent Number: 5,333,549

[45] Date of Patent: Aug. 2, 1994

[54] METHOD FOR PRODUCING PRINTED IMAGES ON FOIL-COVERED SURFACES

[75] Inventor: William Feldman, Arlington, Tex.

[73] Assignee: Playoff Corporation, Grand Prairie, Tex.

[21] Appl. No.: 944,481

[22] Filed: Sep. 14, 1992

[51] Int. Cl.[5] ..... B41F 17/22

[52] U.S. Cl. ..... 101/483; 101/217; 101/463.1; 101/469; 156/233; 156/277

[58] Field of Search ..... 101/483, 492, 460, 463.1, 101/467, DIG. 36, 453, 217, 469; 156/277, 220, 233, 79, 247; 428/172, 207, 213; 427/276

[56] References Cited

U.S. PATENT DOCUMENTS

| | | | |
|---|---|---|---|
| 3,905,849 | 9/1975 | Bomboire | 156/277 |
| 3,912,842 | 10/1975 | Swartz | 428/172 |
| 3,961,947 | 6/1976 | Wells | 101/463.1 |
| 4,012,552 | 3/1977 | Watts | 156/233 |
| 4,018,528 | 4/1977 | Dennis | 101/DIG. 36 |
| 4,168,165 | 9/1979 | Kato et al. | 101/453 |
| 4,458,175 | 7/1984 | Weekley | 101/483 |
| 4,483,732 | 11/1984 | Penta et al. | 156/247 |
| 4,484,970 | 11/1984 | Burzlaff et al. | 156/233 |
| 5,152,225 | 10/1992 | Raganitsch | 101/467 |
| 5,181,471 | 1/1993 | Sillars | 101/483 |

*Primary Examiner*—Eugene H. Eickholt
*Attorney, Agent, or Firm*—Cooper & Dunham

[57] ABSTRACT

A method of printing an image on a foil-covered surface wherein a portion of the surface is coated with opaque white ink provides a unique high-quality graphic wherein the designs printed on bare foil are more prominently presented than, and are sharply differentiated from, designs printed on the surfaces coated with opaque white ink.

13 Claims, 5 Drawing Sheets

METHOD FOR PRODUCING PRINTED IMAGES ON FOIL-COVERED SURFACES

BACKGROUND OF THE INVENTION

The present invention relates to a method for creating printed images on foil-covered surfaces. The method is particularly useful in the manufacture of high-quality printed matter such as sports figure cards or makeup and perfume packaging. However, it also is applicable to other printed matter, such as playing cards, greeting cards, tags, signs and badges.

A novel method of printing an image on a foil-covered surface wherein a portion of the surface is coated with opaque white ink provides a unique high-quality graphic wherein the figures printed on bare foil are more prominently presented in comparison to figures printed on the surfaces covered with opaque white ink.

It is well known in the printing industry that images printed on foil-covered surfaces are prominently presented to the eye This result, known as "foil effect" is even more apparent when juxtaposed with an image printed on a non-foil covered surface.

Methods for producing foil effect are known. One standard industry practice involves spot lamination of foil to selected areas of paper sheets. Through a separate process and by a different machine, the portion of the desired image to be presented with a foil effect is then printed on the foil as the remaining portion of the image is also printed on the non-foil portion of the card.

In this process, as the foil base portion of the surface is created in a process separate from that which prints the image on the foil and non-foil portions of the surface, problems develop in keeping the respective images from printing on the wrong surfaces. The result of this process commonly is an undesirable soft edge between the images. This problem is exacerbated when complex designs are printed. As this procedure requires two separate machines and processes, it also is time consuming and expensive.

Another practice in the industry to create a "foil effect", particularly on baseball or other popular figure cards, comprises printing a 4-color image on plastic sheets, opposite the side from which the printed image will be viewed. Opaque white ink then is printed over areas where foil is not to be revealed. After the inks are dry, foil is laminated to the printed side of the plastic. Paper of suitable weight, which may be printed on the side which will be the back of the completed card, is laminated to the foil which previously had been laminated to the printed plastic. This procedure is complex, time consuming, and inefficient.

Still another method of producing a "foil effect" comprises coating white paper with foil over all of one surface. The parts of the paper where it is desired to block the foil effect are printed in opaque white ink on a letterpress printing press, familiar to those in the printing arts. When the opaque white ink dries, the sheets are printed via offset printing methods, also familiar to those skilled in the printing arts, in different colors, over both the exposed foil and opaque white inked surfaces.

In this process, the opaque white ink is printed on letterpress equipment, and the colors are added on different, offset equipment. The different colored inks are printed on the same offset equipment, but may be printed at different times. Problems develop in making the opaque white ink and colored ink images line up, or "register" with one another Further, letterpress printing is slower than offset printing and this process is very slow.

Thus, it has not been known in view of the prior art to utilize offset printing methods to create sharp, high quality, complex, multi-color, foil-effect designs contrasted with non-foil designs or non-foil backgrounds on the same foil-covered surfaces at relatively high speed and low cost.

SUMMARY OF THE INVENTION

One object of the present invention is to provide an efficient method for creating a unique printed image wherein primary objects are more prominently presented in comparison to background objects.

Another object of the present invention is to provide a method of printing images partially on foil-covered surfaces and partially on foil-covered surfaces covered with opaque white ink, such that the respective images are printed on a single printing press simultaneously.

Another object of the present invention is to provide a method of printing images partially on foil-covered surfaces and partially on foil-covered surfaces covered with opaque white ink, such that the respective images do not overlap.

Still another object of the present invention is to supply a simple and inexpensive means for creating a "foil effect" juxtaposed with images which do not appear to be printed on foil in one procedure which results in sharp, high quality, complex, multi-color designs at a low cost.

In accordance with the present invention, a foil-covered base is printed, on the foil-covered side, with opaque white ink and with different colored inks in one pass through an offset printing press. All inks are applied by identical precision offset photographic plates and the entire process is usually completed in a fraction of a minute. A sharp, high quality, multi-color graphic presentation with "foil effect" results.

The invention relates specifically to high-quality printed material where it is desirable to have certain images more prominently displayed than others, such as cards depicting sports figures, or makeup and perfume packaging. However, it also is applicable to other types of printed matter where a foil effect is desired.

DETAILED DESCRIPTION

Generally, the present invention relates to a method for creating high-quality printed matter wherein a portion of the printed image is printed on bare foil and a portion appears to be printed on a non-foil-covered surface. The method is useful for creating printed matter wherein one or several images are more prominent than others, such as cards depicting sports figures or makeup or perfume packaging. The invention also is applicable to other types of printed matter, where a foil effect is desired.

Prior art methods of creating a foil effect on printed materials are time-consuming, complicated, and can result in poor quality printed material.

In one known method (designated prior art method A for ease of reference), white paper in roll form is slit and cut to form sheets. Foil then is "spot" laminated to selected areas of the paper sheets by a metal die on a machine designed for that purpose. Through a separate process and by a different machine, the portion of the desired image that will be printed on the foil is then printed on the foil at the same time that the remaining portion of the image is printed on the non-foil portion of the card.

Figure 1:
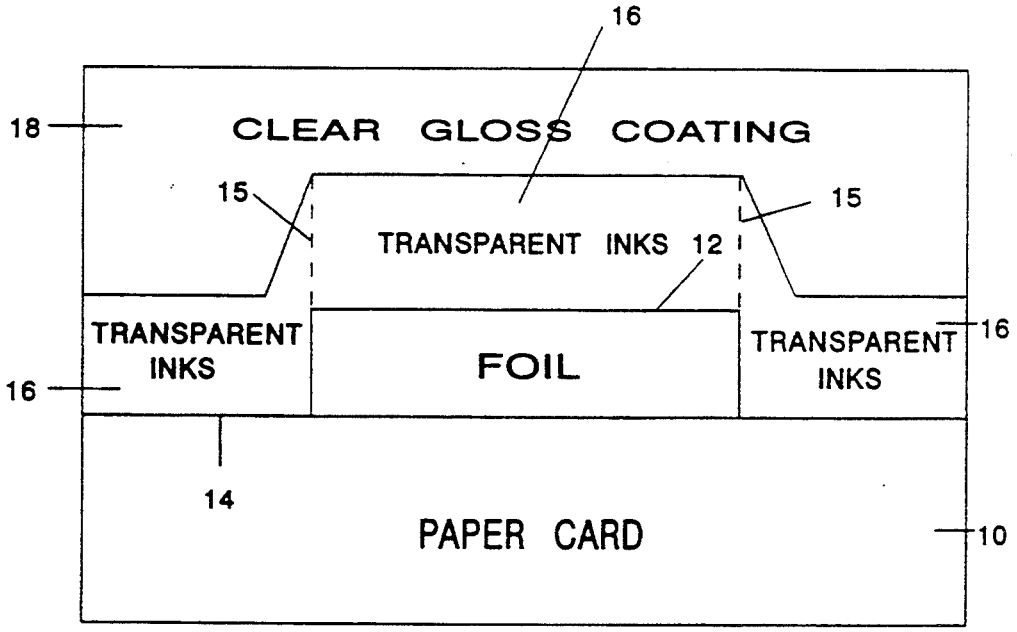
FIG. 1 is a cross-sectional view of a card bearing a printed image created pursuant to the prior art.

FIG. 1 shows a cross-sectional view of material printed in accordance with prior art method A. The material to be printed, shown in FIG. 1 as paper card 10, is partially spot-laminated with foil 12 using a pressure plate, familiar to those skilled in the printing arts. The entire image to be presented is then printed in a layer of transparent colored inks 16 on the surface of paper card 10, over both foil 12 and non-foil surface 14. That portion of the image printed by transparent inks 16 which is to be printed on foil surface 12 is not precisely printed on foil 12, resulting in soft edge 15. Transparent inks 16 may be covered with clear gloss coating 18.

Another prior art method for creating a foil effect, referred to here as prior art method B, comprises unwinding rolls of plastic and placing thin strips of glue along both outer longitudinal edges of the plastic. Thin white paper then is placed on the plastic, adhering to the strips of glue, on the side of the plastic that will be the front of the individual cards. A 4-color image then is printed on the side opposite the side from which the printed image will be viewed. White ink then is printed over areas where foil is not to be revealed. After the inks are dry, foil is laminated to the printed side of the plastic. Paper of suitable weight, which may be printed on the side which will be the back of the completed card, is laminated to the foil which previously had been laminated to the printed plastic. The thin white paper, which served to facilitate printing and prevent scratching of the printed plastic, then is removed.

Figure 2:
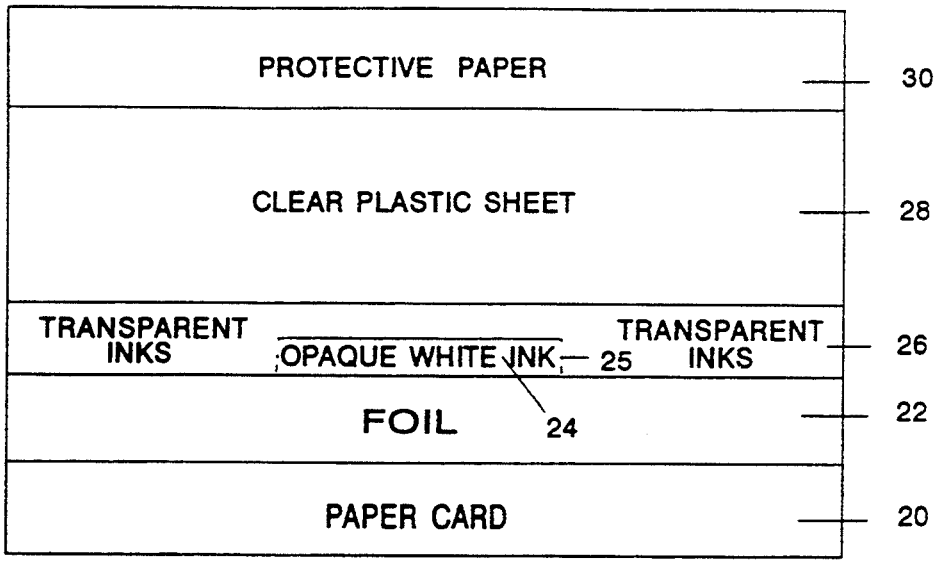
FIG. 2 is a cross-sectional view of a card bearing a printed image created pursuant to the prior art.

FIG. 2 shows in cross-section material printed pursuant to prior art method B. As seen in FIG. 2, an image to be presented is printed on a clear plastic sheet 28 in transparent inks 26. Opaque white ink 24 covers figures which are not to be presented on foil. Opaque white ink 24 and transparent inks 26 are not in sharp register, resulting in soft edge 25. Foil 22 covers transparent inks 26 and opaque white ink 24. One side of paper card 20 is laminated to the back of foil 22. A layer of protective paper 30 is removed at the end of the process to reveal the printed image.

Another method of producing a foil effect, referred to as prior art method C, comprises covering white paper, in roll form, with foil over all of one surface, then slitting and cutting the rolls to make sheets. The parts of the sheets where it is desired to block the foil effect are printed in white ink on a letterpress printing press, wherein the paper is pressed onto an inked, raised surface. When the white ink dries, the sheets are printed via offset printing methods in different colors, over both the exposed foil and white inked surfaces. The offset method involves printing an inked image from a plate onto a rubber-blanketed cylinder, and using the cylinder to transfer the image to the paper being printed.

In this process, the white ink is printed on letterpress equipment, and the colors are added on different, offset equipment. The different non-white inks usually are printed at the same time on the offset equipment, but may also be printed at different times.

Figure 3:
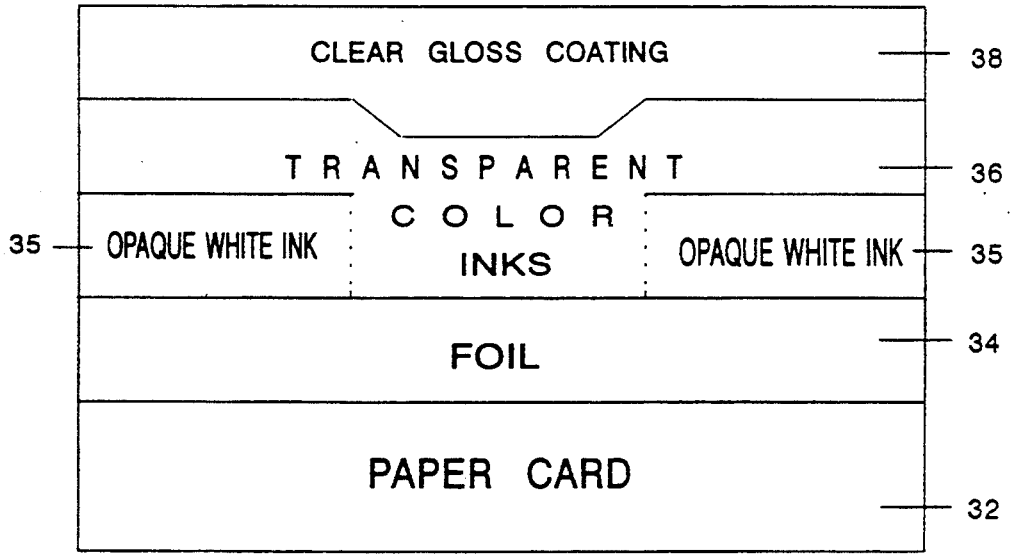
FIG. 3 is a cross-sectional view of a card bearing a printed image created pursuant to the prior art.

FIG. 3 shows in cross-section material printed pursuant to prior art method C. One side of paper card 32 is covered with foil 34 which is laminated to paper card 32. Opaque white ink 35 covers those areas of foil 34 where a foil effect is not desired. The image is then printed on foil 34 and opaque white ink 35 in several different iterations. The image is visible in transparent color inks 36. A clear gloss coating 38 may be added over transparent color inks 36.

In contrast to the above referenced prior art methods of creating a foil effect, the present invention provides a method of creating a high quality foil effect on printed material more efficiently and in a shorter time than the above prior art methods.

Offset printing technology, and particularly waterless offset printing technology, is used in the process of the invention. Offset printing technology is well known to those skilled in the printing arts. It involves imposition of a 2-dimensional photographic image on an offset photographic plate, usually in a process performed by a plate exposure and development system familiar to those skilled in the printing In conventional offset printing, the plates prepared as described above, bearing the desired photographic image, are passed under a roller where a water-based fountain solution of the type known to those in the printing industry is applied to the side of the plates upon which the photographic image has been imposed. The fountain solution adheres to those areas of the plate which do not bear the photographic image.

The plate then is passed under ink rollers, which present ink to the plate. The areas of the plate which are covered with fountain solution do not accept ink, whereas the dry areas of the plate do accept ink.

The inked plate next comes into contact with a rubber blanket mounted on a cylinder, and transfers a reverse copy of the image onto the rubber blanket. As the areas of the plate which do not contain the desired photographic image are covered with a very thin film of the fountain solution and thus do not accept ink, the image transferred to the rubber blanket is an identical, reverse copy of the desired image.

The rubber blanket cylinder then makes contact with paper or other material, and prints a positive image thereon, usually printing many copies of the same image in succession.

Offset printing technology not requiring a fountain solution (hereinafter referred to as "waterless offset printing") operates upon most of the same principles as standard offset printing. Both methods employ the transfer of an image from a specially made photographic plate to a rubber blanket cylinder, and from the rubber blanket cylinder to the paper or other material to be printed.

However, in waterless offset printing, the offset photographic plate is manufactured such that later the area(s) where ink is not to be accepted will be defined with a special, ink-repellant surface which does not allow ink to adhere to the surface when correctly exposed and processed, using methods known to those skilled in the printing arts. The plates may be negative-acting or positive-acting in character. Negative-acting plates form ink accepting areas in those areas exposed to light prior to development. Positive-acting plates form ink accepting areas in those areas protected from light prior to development. Both types of plates can be used in the practice of applicant's invention. Toray Industries, Inc. of New York, N.Y., is a manufacturer of waterless offset photographic printing plates.

On specially designed and equipped presses, images on waterless offset photographic plates may be created electronically through direct imaging, or "DI" technology systems familiar to those skilled in the printing arts. DI technology systems are currently available from Heidelberg Eastern of Glendale, N.Y. and Heidelberg West of Brisbane, Calif. This new process also can be used in the practice of the Applicant's invention.

Currently emerging electronic technology seeks to create waterless images on special cylinders that serve in place of the disposable waterless plates.

The waterless plates do not require a thin film of fountain solution in order to repel ink from the non-image areas. However, they repel ink only when the ink is close to a certain temperature, typically at or near 72° F. or other defined temperature range. The plates come into contact with ink rollers that present ink to the entire plate. The ink adheres only to those areas which are not coated with the ink-repellant surface. The plate then comes into contact with a rubber blanket cylinder, which lifts the image and prints a copy of it on the sheet of cards or other material to be printed. This process typically is repeated many times each minute.

Waterless offset inks are manufactured by most major ink manufacturers. Inks which work well in connection with the present invention are made by Inx International in Arden Hills, Minnesota.

The advantages of waterless offset printing, as opposed to standard offset printing techniques which employ fountain solution, are important to the practice of the invention. Fountain solution tends to run into the edges of inked areas of conventional plates, softening the image printed. The present invention requires that relatively large quantities of opaque white ink be loaded on one offset photographic plate, exacerbating this problem if waterless plates were not used. The ability to avoid fountain solution enables creation of sharp, high quality, foil-effect images with clean division between the color image printed on foil and the image printed on the opaque white ink.

Figure 4:
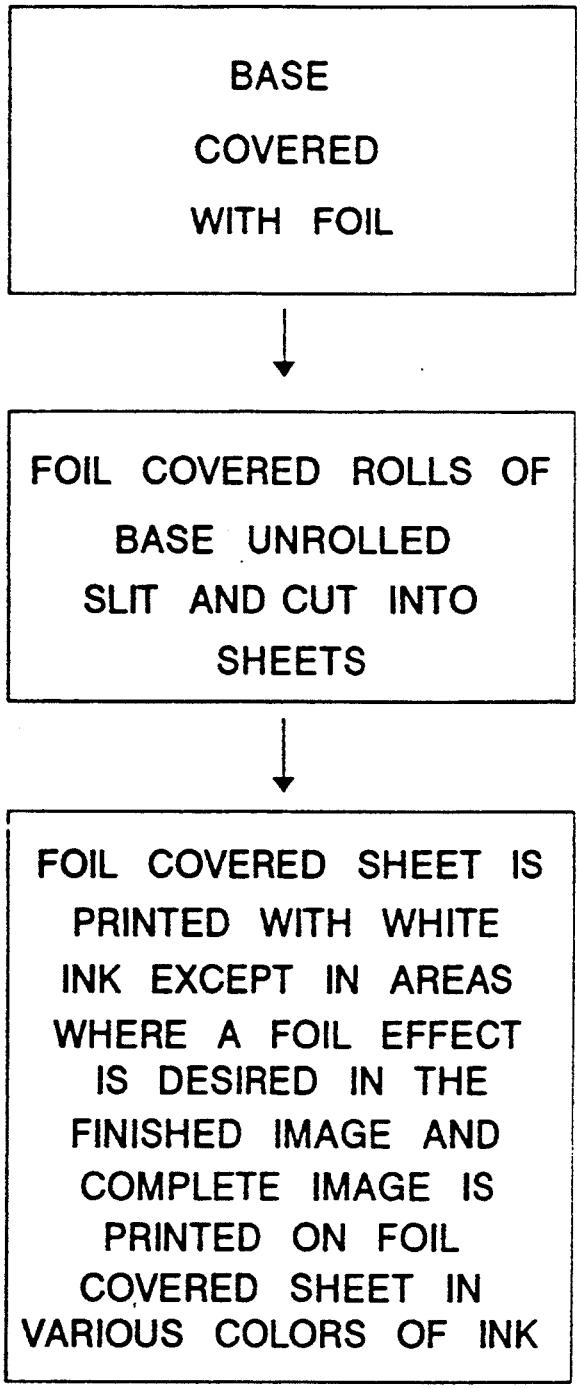
FIG. 4 is a diagram of the steps of a process creating graphic images in accordance with the present invention.

The steps of the novel printing method are best seen in FIG. 4. A base, such as white paper stock in roll form, is covered with foil over essentially all of one surface. Many types of bases can be used to practice the invention. As one side of the base to be printed is covered with foil before it is printed, the printability of that one surface is not a major concern. As a result, less expensive bases can be used.

In one embodiment of the invention, used to create sports figure cards, common box board, such as solid bleached sulfite paper is used as a base. Other bases, such as litho label, recycled content box board, news back box board or synthetic paper also can be used.

Foil covering of the base to be used can be accomplished by a common glue lamination technique, which utilizes heat, pressure and hot glue to bond foil to the base. Glue lamination is performed by several paper companies, including Hamden Paper Company of Holyoke, Massachusetts.

A foil surface can also be created by the process of vacuum metalizing, on machines commonly referred to as vacuum metalizers, such as those manufactured by Galileo Corporation of America of Somers, Conn. Vacuum metalizing services are performed by-several companies, including Van Leer Metalized Products, Ltd. of Framingham, Mass.

Many different types of foil coatings can be selected, depending on the finish desired. In one embodiment of the invention, an aluminum based foil is used. Tinted or laser patterned foils also may be used.

Both the glue lamination and vacuum metalizing techniques commonly yield foil on one surface of the base roll, and re-roll the base.

The foil-covered rolls are unrolled, slit and cut into sheets on conventional sheeters such as those manufactured by Jagenberg Corp. of Enfield, Conn. or Vijuk Corp. of Elmhurst, Ill.

The foil-covered sheets then are passed through a conventional waterless offset printing press which either has been factory designed for waterless printing, or has been retrofitted with special equipment to keep the special inks at or near 72° F. or other defined temperature range required for the special inks to function properly in the waterless offset printing system.

Komori waterless offset printing presses are available in the United States from Komori America Corporation of Rolling Meadows, Ill.

Heidelberg printing presses, available from Heidelberg Eastern of Glendale, N.Y. and Heidelberg West of Brisbane, Calif. can be retrofitted by adding ink cooling systems.

The waterless offset plates are placed in printing units one behind the other, such that the base material to be printed will pass under the location of each printing unit sequentially. One of the plates in the sequence of plates is coated with opaque white ink in all areas which correspond to figures which, in the final printed piece, will not be presented in a foil-effect. In a preferred embodiment, the first plate in the sequence of plates is coated with opaque white ink where required. A high-opacity white waterless ink manufactured by Inx International in Arden Hills, Minnesota renders suitable results. An ink repellent surface covers those areas of the plate which correspond to the figure(s) to be presented with a foil effect. Opaque white ink will not be received by the ink repellent portions of the plate.

The plates which follow the opaque white ink plate in sequence will carry transparent colored or black inks and are coated with an ink-repellent surface in various areas, depending on the final image to be printed and the colors of ink required in each area of the image. Areas coated with the ink-repellent surface will not be printed in the particular ink color carried by the particular plate. At least some of these colored-ink plates will lay black and/or colored inks, on the bare foil surface of the material to be printed and on the surfaces previously covered with opaque white ink. In certain cases, the opaque white ink may print after all or part of the foil effect colors are printed but before black or other color printing on the opaque white ink is printed. If the design calls for no printing on the opaque white ink, the opaque white ink may be the last color printed.

For purposes of explanation, this unique process will be further described with regard to the printing of sheets of baseball cards portraying Babe Ruth holding a bat and standing at home plate. Behind Ruth are a catcher and an umpire, and behind them, a partial view of spectators in a stadium.

A series of Toray offset photographic plates, as described above, are prepared. Each plate bears an identically sized photographic image of the Babe Ruth photograph. In the finished baseball card, Babe Ruth will be presented in four colors of ink. The remainder of the background will be printed in black and white. The Ruth figure will be the prominent figure in the finished product, and it alone will be printed on bare foil.

One Toray photographic plate is prepared which will bear opaque white ink over all areas except the figure of Ruth. This first plate is exposed and processed such that the figure of Ruth is coated with an ink-repellant surface, and the remainder of the photographic image is not.

The other plates will be designed such that they are coated with ink repellant surfaces in areas which, in the finished card, will not be colored with the particular color carried with that plate. For example, a plate that will carry black ink will be coated with ink-repellant surfaces in all areas except for those corresponding to Ruth's belt, hair, and shoes, and areas of the background where black appears.

Similarly, the other plates will be designed to attract ink only in those areas which correspond to the areas of the finished product which require the ink color carried by the particular plate. The plates carrying black and colored inks are designed to print both on the foil-covered surface and the opaque white ink covered surfaces of the cards at the same time. It is only with regard to the first plate, which bears opaque white ink, that a differentiation between primary figures, in this case Ruth, and the background, is necessary.

After the plates are manufactured as discussed above, they are placed sequentially into a waterless offset printing press comprising multiple printing units. In one embodiment, the plate which will carry opaque white ink is placed in a first printing unit such that it will be encountered first by the material to be printed. As described above, the plates are coated with ink by ink rollers which have received ink from the press ink system. The ink rollers offer the inks to the plates.

The first plate is coated heavily with opaque white ink in the areas that will accept ink. A heavy coating of opaque white ink serves to completely cover the foil covering of the paper to be printed in areas where a foil-effect is not desired, and enhances the contrast between foil and non-foil presentation in the finished product. Best results are achieved with one coat of white ink of high opacity. White ink with low opacity can be used. However, two or more essentially identical white ink plates would be necessary to achieve suitable results.

The other plates are coated with different colored inks. Each plate then comes into contact with a rubber blanket which is wrapped around a moveable cylinder. The plate transfers a reverse copy of the image to be printed onto the rubber blanket. The rubber blanket covered cylinders then become positioned, by operation of the offset printing press in a normal manner, such that they will contact paper, or other material to be printed, moving underneath the rubber blanket covered cylinders on impression cylinders.

The base material to be printed is fed into the printing press. Typically, the base material, which has been covered with foil in a separate process as described above, is now in sheet form.

The offset press is started, and the base material, which moves through the machine, commonly on a series of transfer cylinders and impression cylinders, in one embodiment first encounters the blanket carrying opaque white ink, which prints an outline of Babe Ruth in opaque white ink. The entire background of the photograph is imposed upon the paper in opaque white ink, and the image, or silhouette, of Ruth on the foil-covered paper remains free of ink.

The next plate encountered by the base material prints black or colored ink where required, on the same base material which received the opaque white ink. This process is repeated for each successive plate, which when coated with ink by rollers, transfers its image to a rubber blanket which in turn transfers a correct image to paper or other material to be printed.

There is no need for the individual inks, including the opaque white ink, to dry completely before another color is printed.

In one embodiment, the completed card sheet is coated with a fast-drying clear coating. The coating may be applied before the card sheet leaves the printing press but may be coated separately or coated both on the press and again separately from the press.

The finished cards will bear the image of Babe Ruth, prominently presented in a foil effect, in colored inks. The background will be less prominent and will be printed in black and white.

Of course, different variations are possible. The cards easily could be printed, using Applicant's invention, such that both Babe Ruth and the background of the photograph are printed in colored ink, or both are printed in black and white, while Ruth alone is presented with a foil effect. The cards also could be printed such that the background is presented in a foil effect, and Ruth is in black and white, using duotone or quadratone techniques familiar to those skilled in the printing arts.

Many different cards can be printed at once using the process of the invention. The offset printing press can be adapted to accept large sheets of foil-covered paper and the photographic plates can be designed to print multiple photographic images of multiple subjects at once. After printing is completed, the sheets are slit into individual cards on machines known to those skilled in the art, such as the Slipstream distributed by Rollem Corporation of America, of Orange, Calif., or Polar guillotine cutters that are distributed by Heidelberg Eastern of Glendale, New York and Heidelberg West of Brisbane, Calif. Cosmetic boxes may be die-cut.

Figure 5:
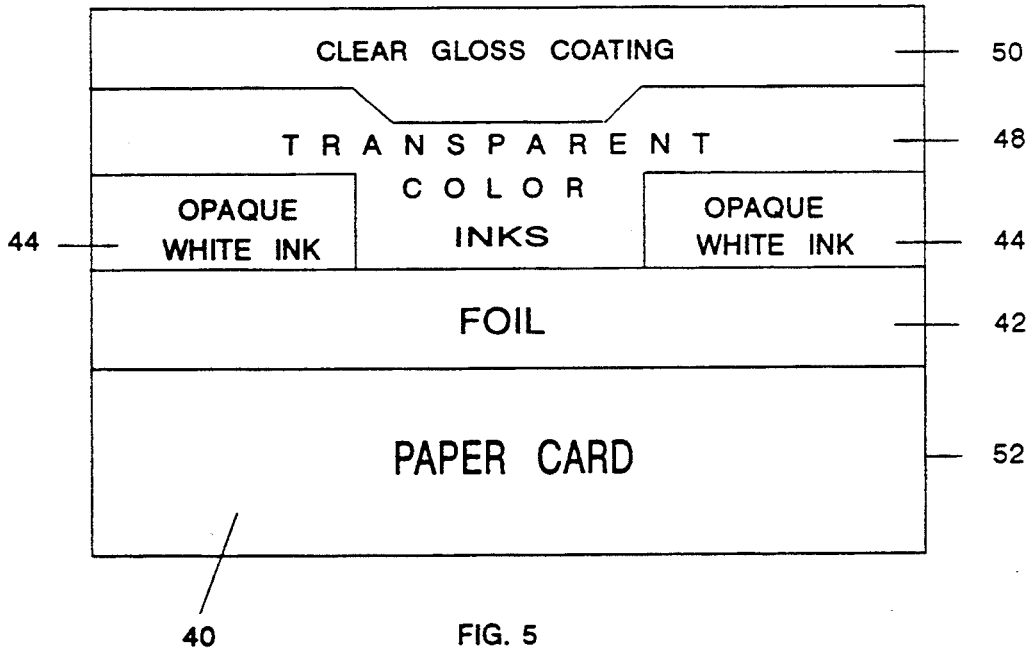
FIG. 5 is a cross-sectional view of a card bearing a printed image created in accordance with the present invention.

A card printed in accordance with the present invention is shown in cross-section in FIG. 5. Paper card 40 is covered over essentially all of one surface with foil 42. Opaque white ink 44 is placed in those areas of finished card 52 which will not show a foil-effect. Transparent color inks 48 prints the desired image on foil 42, where exposed, and on opaque white ink 44, where opaque white ink 44 covers foil 42. The images printed directly on foil 42 are presented to the viewer's eye more prominently than those images printed on opaque white ink 44. In one embodiment, clear gloss coating 50 serves to protect the printed image.

A cross-section of the printed material of FIG. 5 appears superficially similar to that of the material FIG. 3, which is printed partially on letterpress equipment and partially on offset printing equipment. However, as discussed above, the figures in the image on the card of FIG. 3 do not reliably line-up correctly and the line of division between foil-effect and opaque white areas is not clear and sharp, in comparison to cards printed pursuant to the process of the invention.

A comparison of FIGS. 3 and 5 illustrates this difference. The lines of FIG. 3 between opaque white ink 35 and transparent color inks 36 are obscure. Opaque white ink 35 runs into transparent inks 36. In contrast, in FIG. 5, opaque white ink 44 and transparent color inks 48 are sharply differentiated.

It should be appreciated that the specification and drawings depict one presently preferred embodiment of the invention. Other changes and modifications may be made, as would be apparent to those skilled in the art.

I claim:

1. A method of creating a printed image on a boxboard base, comprising the steps of:

covering said boxboard base with foil using vacuum metalizing or glue lamination, over all or a portion of one surface:

printing one coat of opaque white ink on said foil-covered surface of said boxboard base in a single pass through said waterless offset printing press, such that less than the total surface area of said foil-covered surface of said boxboard base is coated with said opaque white ink; and printing transparent ink on said foil-covered boxboard base in a single pass through a waterless offset printing press, such that an image is defined wherein at least a portion of said image is printed on said portions of said boxboard base which are coated with said opaque white ink and at least a portion of said image is printed on said portions of said boxboard base which are not coated with said opaque white ink.

2. The method of claim 1 wherein said base is solid bleached sulfite box board.

3. The method of claim 1 wherein said base is litho label.

4. The method of claim 1 wherein said base is recycled content box board.

5. The method of claim 1 wherein said base is paper stock.

6. The method of claim 1 wherein said base is news back box board.

7. The method of claim 1 wherein said base is synthetic paper.

8. A method of creating a printed image wherein at least one portion of said printed image is presented more prominently in comparison with other portions of said printed image, comprising the steps of:

Creating a primary offset photographic plate wherein the photographic surface of said primary offset photographic plate is coated with an ink-repellant surface in areas corresponding to said portion of said printed image to be presented prominently, Creating at least one secondary offset photographic plate wherein the photographic surface of said secondary offset photographic plate is coated with an ink-repellant surface in areas which do not correspond to said portion of said printed image to be presented prominently;

Coating said photographic surface of said primary offset photographic plate with opaque white ink;

Coating the photographic surface of said secondary offset photographic plate with ink other than opaque white ink;

Contacting said primary offset photographic plate with a primary rubber blanket cylinder, wherein a reverse copy of said image defined by said primary offset photographic plate is transferred to said primary rubber blanket cylinder;

Contacting said secondary offset photographic plate with a secondary rubber blanket cylinder, wherein a reverse copy of said image defined by said secondary offset photographic plate is transferred to said secondary rubber blanket cylinder;

Contacting said primary rubber blanket cylinder with a foil-covered surface, wherein said primary rubber blanket cylinder transfers a positive copy of said image defined by said primary offset photographic plate to said foil covered surface; and Contacting said secondary rubber blanket cylinder with said foil-covered surface, wherein said secondary rubber blanket cylinder transfers a correct copy of said image defined by said secondary offset photographic plate to said foil covered surface;

Whereby said printed image is presented on said foil-covered surface more prominently than on said other portions.

9. The method of claim 8 wherein said offset photographic plates are created by direct imaging technology.

10. The method of claim 8 wherein said offset photographic plates are created by electronic technology.

11. The method of claim 8 wherein said offset photographic plates are all positive acting plates.

12. The method of claim 8 wherein said offset photographic plates are all negative acting plates.

13. The method of claim 8 wherein at least one of said offset photographic plates is a positive acting plate and at least one of said offset photographic plates is a negative acting plate.

* * * * *